United States Patent [19]

Blackburn et al.

[11] Patent Number: 4,923,636

[45] Date of Patent: May 8, 1990

[54] DETERGENT COMPOSITIONS

[75] Inventors: Stephen N. Blackburn, Chester, England; Francois Delwel, NE Dordrecht, Netherlands; Elfed H. Evans, Clwyd, Scotland

[73] Assignee: Lever Brothers Company, New York, N.Y.

[21] Appl. No.: 317,178

[22] Filed: Mar. 30, 1989

Related U.S. Application Data

[62] Division of Ser. No. 109,340, Oct. 16, 1987.

[30] Foreign Application Priority Data

Oct. 20, 1986 [GB] United Kingdom ..... 8625104

[51] Int. Cl.[5] ..... C11D 1/12; C11D 1/755; C11D 1/83; C11D 1/831

[52] U.S. Cl. ..... 252/550; 252/173; 252/531; 252/539; 252/DIG. 14

[58] Field of Search ..... 252/174.13, 174.21, 252/539, 559, DIG. 14, 550

[56] References Cited

U.S. PATENT DOCUMENTS

| | | | |
|---|---|---|---|
| 2,875,153 | 2/1954 | Dalton | 252/132 |
| 4,082,682 | 4/1978 | Inamorato et al. | 252/92 |
| 4,102,823 | 7/1978 | Matheson et al. | 252/533 |
| 4,228,025 | 10/1980 | Jacobson | 252/99 |
| 4,820,448 | 4/1989 | Wegener et al. | 252/533 |

FOREIGN PATENT DOCUMENTS

| | | |
|---|---|---|
| 125854 | 5/1984 | European Pat. Off. . |
| 145065 | 11/1984 | European Pat. Off. . |
| 211493 | 6/1986 | European Pat. Off. . |
| 259741 | 8/1987 | European Pat. Off. . |
| 1251853 | 12/1960 | France . |
| 1551074 | 8/1976 | United Kingdom . |
| 1579261 | 2/1977 | United Kingdom . |

OTHER PUBLICATIONS

Tenside in unserer Welt-heute und morgen; Berichte vom Welt-Tensid-Kongree, Munchen, 6th to 10th May 1984, vol. IV.

European Search Reports. European Patent Office Official Actions.

Belgian 623881 and 623882 (Abstracts).

*Primary Examiner*—Paul Lieberman
*Assistant Examiner*—James M. Silbermann
*Attorney, Agent, or Firm*—James J. Farrell

[57] ABSTRACT

A liquid surfactant composition mobile at 20°-80° C. contains up to 80% anionic surfactant (sodium or potassium alkylbenzene sulphonate and/or alkyl sulphate), up to 80% nonionic surfactant and less than 10% by weight of water. The liquid composition may be sprayed onto a solid particulate absorbent material to form a detergent powder or component thereof.

2 Claims, No Drawings

DETERGENT COMPOSITIONS

This is a division of Ser. No. 109,340, filed 10/16/87.

FIELD OF THE INVENTION

This invention relates to fluid mixtures of anionic and nonionic surfactants, and to processes for converting them into detergent powders.

BACKGROUND AND PRIOR ART

Recent trends in the detergents market are towards fabric washing powders which are denser than hitherto. The reasons for this are partly due to reduced packaging costs and partly due to an improved washing performance because consumers tend to dispense washing powders by volume rather than by weight. The majority of washing powders are presently manufactured by a spray-drying process and this tends to produce powders of relatively low bulk density, that to say is typically less than 500 g/liter. The bulk density is very dependent on the amount and type of active detergent present in the powder during the spray-drying operation.

The commonly used anionic detergents, sodium alkyl sulphates and sodium alkyl aryl sulphonates, are particularly prone to produce light powders.

It has been discovered that powders with higher bulk densities can be obtained if part of the active detergent is sprayed onto the spray-dried powders rather than incorporated into the slurry before spray-drying. However, in order to be suitable for spraying onto the powders, the active detergents (surfactants) must be sufficiently mobile at temperatures below about 80° C. to be atomised effectively.

GB No. 1 579 261 (Colgate-Palmolive Co) relates to processes for converting various liquid or liquefiable detergents into detergent powders by spraying those surfactants onto spray-dried builder beads. The specification refers to synthetic detergents such as nonionics, anionics and cationics or combinations thereof as in general being liquid or liquefiable. In our experience, so far as mixtures of aqueous anionic and nonionic surfactants are concerned, these mixtures are viscous gels which can only be oversprayed onto particulate absorbents if they are heated to a temperature, typically above 90° C., at which they become sufficiently mobile. That is severely disadvantageous in factory practice.

EP No. 88 612A (Bridgemace) discloses mobile liquid detergents containing not more than 8% water and not less than 90% active detergent, including an anionic surfactant, a nonionic polyether, and coconut mono- or diethanolamide. Substantial quantities of the third ingredient (at least 20% in every Example, about 33% being apparently preferred) are required in order to obtain sufficiently mobile liquid products.

GB No. 1 169 594 (Unilever) discloses liquid detergent compositions comprising ammonium alkylbenzenesulphonate and a nonionic detergent. The compositions are prepared by passing ammonia through a mixture of alkylbenzenesulphonic acid and nonionic detergent.

We have now discovered a range of compositions comprising anionic surfactant, nonionic surfactant and water which are sufficiently mobile at temperatures no higher than 80° C. to enable them to be sprayed onto absorbents.

DEFINITION OF THE INVENTION

According to the invention there is provided a liquid surfactant composition mobile at a temperature within the range of from 15° to 80° C. and consisting essentially of (a) a sodium or potassium salt of an alkylbenzene sulphonate or alkyl sulphate in an amount not exceeding 80% by weight, (b) an ethoxylated nonionic surfactant in an amount not exceeding 80% by weight, (c) the balance being water in an amount not exceeding 10% by weight.

The invention further provides a process for the manufacture of a particulate detergent composition or a component therefor, which comprises spraying onto a solid particulate absorbent material at a temperature within the range of from 15° to 80° C. a mobile liquid surfactant composition consisting essentially of (a) an alkylbenzene sulphonate or alkyl sulphate in an amount not exceeding 80% by weight, (b) an ethoxylated nonionic surfactant in an amount not exceeding 80% by weight, (c) the balance being water in an amount not exceeding 10% by weight.

DESCRIPTION OF THE INVENTION

Preferred compositions according to the invention contain 20–60% anionic surfactant and 20–60% nonionic surfactant, and as little water as possible. Compositions in which the ratio of anionic surfactant to nonionic surfactant is from 0.125:1 to 4:1 are of especial interest.

The nonionic surfactant is preferably an ethoxylated or mixed ethoxy-propoxylated primary or secondary aliphatic alcohol. Most preferred are ethoxylated primary alcohols, especially $C_8$–$C_{15}$ primary alcohols ethoxylated with from 2 to 25 moles of ethylene oxide per mole of alcohol.

The anionic surfactant component in the composition of the invention may be a sodium or potassium alkyl sulphate salt, or, especially, a sodium or potassium alkylbenzene sulphonate salt. Particularly suitable alkylbenzene sulphonates are sodium $C_{12}$–$C_{15}$ alkylbenzene sulphonates. Suitable alkyl sulphates are sodium $C_{12}$–$C_{15}$ alkyl sulphates, although other alkyl sulphates outside this carbon chain length range, and potassium alkyl sulphates may also be used.

The method of preparation of the liquid mixture of the invention is important. Simple admixture of normally 50% aqueous neutralised alkylbenzene sulphonate paste and liquid nonionic surfactant in the desired proportions will give not a mobile isotropic liquid but a highly viscous gel which is difficult to handle and to atomise.

According to a first method, liquid nonionic surfactant may be gradually added to an alkylbenzene sulphonate paste (neutral salt) which will typically have an active matter content of about 50% by weight. The resulting viscous mixture, containing more than 10% water, is then heated to a sufficiently high temperature for a sufficient period of time for the water content to fall below 10% by evaporation. A clear mobile liquid is obtained and this remains clear and mobile when allowed to cool to ambient temperature.

According to a second method, alkylbenzene sulphonic acid may be mixed with nonionic surfactant, and the mixture treated with concentrated aqueous sodium hydroxide or potassium hydroxide to effect partial or complete neutralisation. Mixtures fluid at 20° to 80° C. and containing about 6 to 7% by weight of water may be produced by this method.

According to a variant of the second method, the alkylbenzene sulphonic acid starting material may be in partially neutralised form.

The mixtures of the invention, if sufficiently mobile at ambient temperature, are useful in their own right as concentrated liquid detergents. These may, for example, be used as such or in diluted form as dishwashing liquids.

The invention is primarily concerned, however, with the preparation of granular detergent products by spraying the liquid mixtures of the invention onto absorbent granular base materials. For this proposed use the limits on fluidity are a little less stringent in that compositions of the invention should be sufficiently mobile at a temperature within the range of from 20° to 80° C. to be sprayable.

The process of the invention is highly suitable for the manufacture of detergent powders of high bulk density. For example, the solid particulate absorbent material may have a bulk density of at least 300 g/liter, preferably at least 500 g/liter, and the value after spray-on will be even higher because the spraying-on operation will generally lead to an increase in bulk density. The usefulness of the process of the invention is not, however, limited to very dense products: the process may be used to produce products over the whole range of densities.

If the absorbent material is alkaline, a variant of the process of the invention may be employed whereby the liquid mixture is in effect formed in situ on the absorbent material. A mixture of partially neutralised alkylbenzene sulphonic acid (sulphonate) and nonionic surfactant may be sprayed onto the absorbent material: neutralisation of the alkylbenzene sulphonic acid is completed by the absorbent base material.

A number of possible solid absorbent base materials may be used. One which has many advantages is spray-dried detergent base powder, that is to say the powder which is conventionally produced by spray-drying an aqueous slurry comprising detergency builder, sodium silicate (usually), and other more minor components in a spray-drying tower. It is permissible to incorporate some surfactant into the slurry to be spray-dried without seriously decreasing the density of the material or its absorbency. Amounts of up to 2% by weight of anionic surfactant or up to 5% by weight of nonionic surfactant can be tolerated.

In an alternative approach, the surfactant mixture of the invention may be sprayed onto an inorganic carrier material which is subsequently dry-mixed with other necessary or desirable components of the final composition. The inorganic carrier material may itself be spray-dried: examples of suitable absorbent spray-dried inorganic carrier materials are sodium carbonate/sodium bicarbonate mixtures as described and claimed in GB 1 595 769 (Unilever); sodium carbonate/sodium silicate mixtures as described in GB 1 595 770 (Unilever); and, of especial interest, crystal-growth-modified sodium carbonate monohydrate and crystal-growth-modified Burkeite (sodium carbonate/sodium sulphate) as described in EP 221 776 (Unilever) published May 13, 1987.

Crystal-growth-modified sodium carbonate monohydrate and Burkeite may be prepared by spray drying an aqueous slurry comprising sodium carbonate, and optionally also comprising sodium sulphate in a weight ratio of sodium carbonate to sodium sulphate of at least 0.03:1, the total amount of sodium carbonate and (if present) sodium sulphate being at least 10% by weight based on the dried powder; an effective amount of a crystal growth modifier which is an organic material having at least three carboxyl groups in the molecule; and optionally one or more anionic and/or nonionic detergent-active compounds, one or more detergency builders and/or one or more further heat-insensitive detergent components; the crystal growth modifier being incorporated in the slurry not later than the sodium carbonate; whereby crystal growth-modified sodium carbonate monohydrate and/or crystal-growth-modified Burkeite is or are formed in the slurry.

The crystal growth modifier is a polycarboxylate, monomeric polycarboxylates, for example, salts of ethylenediaminetetraacetic acid, nitrilotriacetic acid and citric acid, may be used but the levels required are rather high, for example, 5 to 10% by weight based on the carbonate and, if present, sulphate. Preferred polycarboxylate crystal growth modifiers used in the invention are polymeric polycarboxylates. Amounts of from 0.1 to 20% by weight, preferably from 0.2 to 5% by weight, based on the total amount of sodium carbonate and (if present) sodium sulphate, are generally sufficient, but higher levels of polymer, for example, up to 60% by weight based on the specified salts, may be present in compositions of the invention (other than the model system mentioned above) for reasons other than crystal growth modification, for example, building, structuring or antiredeposition.

The polycarboxylate crystal growth modifier preferably has a molecular weight of at least 1000, advantageously from 1000 to 300,000, especially from 1000 to 250,000. Powders having especially good dynamic flow rates may be prepared using polycarboxylate crystal growth modifiers having molecular weights in the 3000 to 100,000 range, especially 3500 to 70,000 and more especially 10,000 to 70,000. All molecular weights quoted herein are those provided by the manufacturers.

Preferred crystal growth modifiers are homopolymers and copolymers of acrylic acid or maleic acid. Of especial interest are polyacrylates, acrylic acid/maleic acid copolymers, and acrylic phosphinates.

Suitable polymers, which may be used alone or in combination, include the following:

- salts of polyacrylic acid such as sodium polyacrylate, for example Versicol (Trade Mark) E5 E7 and E9 ex Allied Colloids, average molecular weights 3500, 27,000 and 70,000; Narlex (Trade Mark) LD 30 and 34 ex National Adhesives and Resins Ltd, average molecular weights 5000 and 25,000 respectively; Acrysol (Trade Mark) LMW-10, LMW-20, LMW-45 and A-1N ex Rohm & Haas, average molecular weights 1000, 2000, 4500 and 60,000; and Sokalan (Trade Mark) PAS ex BASF, average molecular weight 250,000;
- ethylene/maleic acid copolymers, for example, the EMA (Trade Mark) serices ex Monsanto;
- methyl vinyl ether/maleic acid copolymers, for example Gantrez (Trade Mark) AN119 ex GAF Corporation;
- acrylic acid/maleic acid copolymers, for example, Sokalan (Trade Mark) CP5 ex BASF; and
- acrylic phosphinates, for example, the DKW range ex National Adhesives and Resins Ltd or the Belsperse (Trade Mark) range ex Ciba-Geigy AG, as disclosed in EP 182 411 A (Unilever).

Mixtures of any two or more crystal growth modifiers may if desired be used in the compositions of the invention.

In general, the use of spray-dried absorbent materials is appropriate for the manufacture of detergent powders with a range of bulk densities from low (300g/l) to quite high (700 g/l).

In addition to the materials already referred to as necessarily being present because of the nature of the invention, a large number of other materials may be present in the compositions produced by the process of the invention. Although some of the absorbent materials referred to above can be materials which also have a detergency building action, it is also possible to add detergency builders to the compositions, by including them in any crutcher slurry which is produced and spray-dried, or by adding them to the composition produced by the spray-drying step. Examples of such detergency builders are sodium tripoly-, pyro- and orthophosphates, sodium aluminosilicates including zeolites, sodium carbonates, sodium citrate and various organic detergency builders such as sodium nitrilotriacetate. Generally, detergency builders will be present in amounts of from 15 to 50% by weight of the final product, amounts of from 25 to 40% by weight being more general.

Detergent powders according to the invention may contain other conventional ingredients added either via the slurry (if the absorbent is a spray-dried powder) or by simple mixing in accordance with their known properties. Such ingredients include enzymes, fluorescers, antiredeposition agents, bleaches, bleach activators, bleach stabilisers, lather suppressors, dyes and perfumes.

EXAMPLES

The invention is further illustrated by the following non-limiting Examples.

EXAMPLE 1

A mobile liquid mixture suitable for spraying was prepared by admixing 5 parts by weight of a nonionic surfactant ($C_{12}$–$C_{15}$ alcohol 7EO) with 10 parts by weight of an aqueous sodium ($C_{10}$–$C_{12}$) alkylbenzene sulphonate paste (50% active matter), and heating the resultant mixture until it had lost about 4 parts by weight of water. The resulting mobile liquid contained (by weight) 5% water, 45% alkylbenzene sulphonate and 45% nonionic surfactant.

EXAMPLES 2 to 5

Mobile mixtures of anionic and nonionic surfactants were also prepared without the evaporation stage by mixing nonionic surfactant with a $C_{10}$–$C_{13}$ alkyl benzene sulphonic acid and then adding sufficient caustic soda solution (100° Tw) partially or completely to neutralise the sulphonic acid.

By this method liquid mixtures containing the following proportions of the three ingredients were obtained:

| | 2 | 3 | 4 | 5 |
|---|---|---|---|---|
| Water | 5 | 8 | 8 | 9.5 |
| Alkylbenzene sulphonate | 23 | 48 | 57 | 65 |

-continued

| | 2 | 3 | 4 | 5 |
|---|---|---|---|---|
| Nonionic surfactant | 72 | 44 | 35 | 25.5 |

All the above mixtures were sufficiently mobile at 70° C. to be atomised effectively in a spray nozzle.

EXAMPLE 6

An aqueous crutcher slurry containing 46% by weight of water was spray-dried in a counter-current spray-drying tower to a base powder having a bulk density of 710 g/liter and a moisture content of 15.8%. The formulation of the powder prepared was as follows:

| | Parts by weight |
|---|---|
| $C_{12}$–$C_{15}$ alcohol 7EO ethoxylate | 3.0 |
| Sodium tripolyphosphate | 23.0 |
| Sodium carbonate | 5.0 |
| Sodium silicate | 6.0 |
| Sodium sulphate | 16.0 |
| Water and minor components | 10.0 |

A mobile mixture of anionic and nonionic surfactant in accordance with the invention, manufactured by mixing 3.8 parts of $C_{10-13}$ alkylbenzene sulphonic acid with 6 parts of a $C_{12-15}$ primary alcohol 7EO ethoxylate and neutralising the sulphonic acid with caustic soda solution of 100° Tw, was then sprayed onto the powder, as it cascaded from one belt to another.

In a third stage a liquefied mixture of sodium monostearyl phosphate and petroleum jelly in a weight ratio of 1.3 : 1 was sprayed onto the powder at the rate of 0.8 parts to 63.

Finally, the powder was dosed with heat-sensitive components such as oxygen bleaches, perfumes and enzymes in accordance with conventional practice to produce a finished powder having the following composition:

| | % by weight |
|---|---|
| Sodium $C_{10-13}$ alkylbenzene sulphonate | 4.0 |
| $C_{12-15}$ primary alcohol ethoxylate 7EO | 9.0 |
| Sodium tripolyphosphate | 23.0 |
| Sodium carbonate | 5.0 |
| Sodium silicate | 6.0 |
| Sodium sulphate | 26.9 |
| Sodium perborate | 12.0 |
| Tetraacetyl ethylene diamine | 0.1 |
| Sodium carboxymethylcellulose | 0.9 |
| Sodium stearyl phosphate | 0.2 |
| Petroleum jelly | 0.6 |
| Enzyme marumes | 0.4 |
| Cellulose ether anti-redeposition aid | 0.3 |
| Water, perfume and minor components balance to | 100.0 |

The finished powder produced had a bulk density of 800 g/liter.

EXAMPLE 7

This Example describes a powder in which a surfactant mixture in accordance with the invention is sprayed onto a crystalline inorganic spray-dried carrier material—Burkeite—and other detergent components are subsequently mixed in.

A particulate adsorbent material consisting of spray-dried crystal-growth-modified Burkeite containing 1.5% by weight of water was prepared as described in Example 4 of EP 221 776 (Unilever) published May 13, 1987 by spray-drying a slurry containing sodium polyacrylate (1% by weight), sodium carbonate (12.5% by weight), sodium sulphate (34% by weight) and water (53.5% by weight).

10 parts by weight of a surfactant mixture in accordance with the invention, consisting of 6.3 parts by weight of alkylbenzene sulphonate, 3.0 parts by weight of nonionic surfactant and 0.7 parts by weight of water, prepared as described in Example 6 above, were sprayed onto 30 parts by weight of the Burkeite base : the latter retained its free-flowing properties. Builders, bleach, enzyme, additional sodium sulphate and minor ingredients were then admixed to give a powder having the following composition:

| | Parts by weight |
|---|---|
| Surfactants | 10.0 |
| Burkeite base | 30.0 |
| Sodium perborate | 10.0 |
| Sodium tripolyphosphate | 25.0 |
| Sodium sulphate | 15.0 |

-continued

| | Parts by weight |
|---|---|
| Bleach activator, enzyme, minor ingredients | 10.00 |
| | 100.00 |

The powder was very free-flowing and non-dusty, and had a very low moisture content, giving good storage stability.

We claim:

1. An aqueous liquid surfactant composition mobile at a temperature within the range of from 20° to 80° C. characterised in that the composition consists essentially of (a) a sodium or potassium salt of an alkylbenzene sulphonate or alkyl sulphate in an amount of about 20% to 60% by weight.

(B) an ethoxylated nonionic surfactant in an amount of about 20% to 60% by weight.

(C) the balance being water in an amount not exceeding 10% by weight.

2. A composition as claimed in claim 1 wherein the weight ratio of component (a) to component (b) is within the range of from 0.125:1 to 4:1.

* * * * *